United States Patent [19]

Plantinga

[11] 3,986,284

[45] Oct. 19, 1976

[54] INFORMATION BOX ADAPTED TO BE ATTACHED TO THE POST OF A BUS STOP OR TRAM STOP INDICATOR

[75] Inventor: Simon Plantinga, Gorredijk, Netherlands

[73] Assignee: Info-Systems Holland B.V., Gorredijk, Netherlands

[22] Filed: July 17, 1975

[21] Appl. No.: 596,749

[30] Foreign Application Priority Data

Jan. 24, 1975 · Netherlands ..... 7500882

[52] U.S. Cl. ..... 40/145 R; 248/125

[51] Int. Cl.[2] ..... G09F 7/18

[58] Field of Search ..... 40/145 R, 145 A, 131 R, 40/131 A, 125 H, 64 R, 125 K, 125 R; 248/43, 125, 176; 403/348, 349, 353

[56] References Cited

UNITED STATES PATENTS

| | | | |
|---|---|---|---|
| 1,959,849 | 5/1934 | Andresen | 40/145 R |
| 2,625,762 | 1/1953 | McColl | 40/145 R |
| 2,759,281 | 8/1956 | Akers | 40/145 R X |
| 3,345,766 | 10/1967 | Timlin | 40/64 R |
| 3,471,968 | 10/1969 | Letz | 248/125 X |
| 3,750,314 | 8/1973 | Crawford | 40/145 R X |

*Primary Examiner*—John F. Pitrelli

*Attorney, Agent, or Firm*—Haseltine, Lake & Waters

[57] ABSTRACT

An information box adapted to be attached to the post of a bus stop or tram stop indicator, comprising a cover, a bottom, and a set of information carriers enclosed between the cover and the bottom. A tube which may be attached to said post is provided with at least one outwardly projecting upstanding rib, but otherwise has a cylindrical outer surface through at least part of its height, each rib being provided with two spaced superposed incisions within the zone of said cylindrical outer surface. An upper ring and a lower ring may be connected with the cover and the bottom, respectively, the cover, the bottom and the rings being provided with passage holes having the same circumference as the tube so that they may be slid on the tube, and the rings being rotatable at the level of the incisions from a slide-on position into an operative position in which they are guarded against vertical displacement by the rib or ribs.

10 Claims, 8 Drawing Figures

INFORMATION BOX ADAPTED TO BE ATTACHED TO THE POST OF A BUS STOP OR TRAM STOP INDICATOR

BACKGROUND OF THE INVENTION

The invention relates to an information box adapted to be attached to the post of a bus stop or tram stop indicator, comprising a cover, a bottom, and a set of information carriers together forming a substantially prismatic structure and enclosed between the cover and the bottom.

SUMMARY OF THE INVENTION

It is the subject of the invention to provide an information box of this kind which may readily be mounted on the post and which allows for a rapid exchange of the information carriers.

For this purpose the information box according to the invention is characterized by a tube attachable to said post, provided with at least one outwardly projecting upstanding rib, but otherwise having a cylindrical outer surface through at least part of its height, each rib being provided with two spaced superposed incisions within the zone of said cylindrical outer surface, and by an upper ring and a lower ring, connectable with the cover and the bottom respectively, the cover, the bottom and the rings being provided with passage holes having the same circumference as the tube so that they may be slid on the tube, and the rings being rotatable at the level of the incisions from a slide-on position into an operative position in which they are guarded against vertical displacement by the rib or ribs.

Due to the co-operation of the rotatable rings and the rib or ribs of the tube provided with incisions, comparable with a bayonet joint, the information box may be mounted in a very simple manner. After the information box has been mounted, the rings are rigidly connected with the cover and the bottom, respectively.

In order to exchange the information carriers of which the upper and lower edges are generally engaged in grooves of the cover and the bottom, respectively, the upper ring is loosened from the cover and turned back to the slide-on position after which the ring and the cover may be lifted. When the information carriers have been replaced by other carriers, the cover is again fixed in the operative position by means of the upper ring.

Preferably the upper ring is provided with a plurality of slots for receiving connecting bolts, these slots being coaxial with the cylindrical portion of the passage hole.

In this case the connecting bolts need only be slightly loosened to enable the ring to be rotated with respect to the cover.

In a suitable embodiment of the information box according to the invention, one end of each of the said slots communicates with a recess engaging the head of the associated connecting bolt in the operative position of the upper ring.

In this manner the ring is additionally guarded against rotation with respect to the cover.

It is of advantage that each of the said connecting bolts co-operates with a nut secured to the underside of the cover.

As a consequence the connecting bolts attaching the ring to the cover are accessible from the top. In order to prevent the connecting bolts as much as possible from loosening by unauthorized persons, use may be made of socket bolts, which can only be operated by means of a special tool.

According to a further feature of the invention the groove provided in the inner surface for the passage hole of the upper ring for receiving the rib when the ring is slid onto the tube is provided on one side with a cam surface whereby the upper ring is downwardly displaced when it is turned into its operative position. By these means an effective clamping action is exerted on the information carriers when the ring is rotated from the slide-on position into the operative position.

Each rib of the tube may be provided with a third incision above the two first-mentioned incisions. This makes it possible to suspend the cover temporarily during the exchange of the information carriers at a somewhat higher level by means of the upper ring so that both hands remain available for the manipulation of the information carriers.

The lower ring connected with the bottom may be provided with square holes for receiving square portions of a second set of connecting bolts each co-operating with a nut supported by the upperside of the bottom. It is thereby rendered impossible to loosen the connecting bolts by which the lower ring is attached to the bottom.

In order to prevent the tube from being removed from the post by unauthorized persons the tube may be connectable with the post by means of a transverse bolt extending through holes in the tube and the post and enclosed by the information box in its operative condition.

BRIEF DESCRIPTION OF THE DRAWINGS

The invention will be further explained by reference to the drawings showing a preferred embodiment of the information box according to the invention.

DESCRIPTION OF A PREFERRED EMBODIMENT

Figure 2:
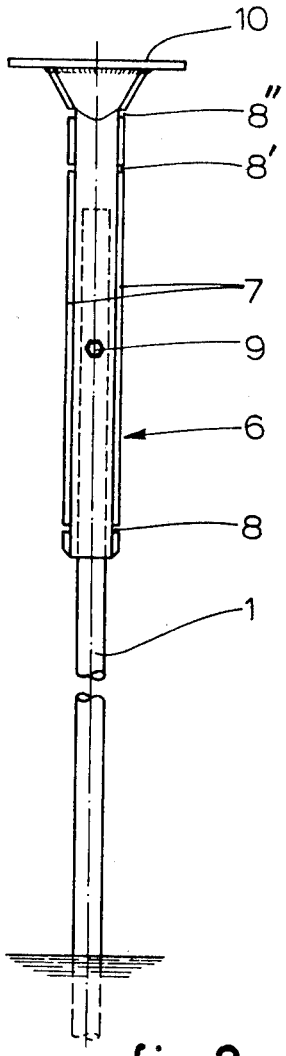
FIG. 2 shows a front view of the post to which the tube of the information box is attached.

The drawings show an embodiment of an information box according to the invention which is attached to the post 1 of a bus stop indicator.

The information box comprises a cover 2 and a bottom 3 which may be made of a synthetic material, such as polyurethane. The cover 2 and the bottom 3 are provided with grooves 4 for receiving the upper and lower edges, respectively, of the information carriers 5. The information carriers 5 may comprise a time-table panel and an aluminium plate consisting of two portions interconnected by a curved section and carrying advertising material. Together the information carriers 5 form at least approximately a trilateral prismatic structure.

The post 1 carries a tube 6 preferably made of aluminium which is provided with two diametrically opposed ribs 7, but has otherwise a cylindrical outer surface extending substantially to the lower end of the tube 6 and extending through the major part of the height of the tube. In the region of that cylindrical outer surface each of the ribs 7 is provided with three spaced superposed incisions 8, 8′ and 8″. The tube 6 is connected with the post 1 by means of a transverse bolt 9 extending through holes in the tube and in the post.

The upper portion of the tube 6 has been flattened and is connected by welding with a supporting plate 10 to which a bus stop indicating panel 11 is attached by means of bolts.

The cover 2 co-operates with an upper metallic ring 12 and the bottom 3 co-operates with a lower metallic ring 13. The cover 2, the bottom 3 and the rings 12 and 13 may be slid on the tube 6 and are provided for this purpose with passage holes 14 having the same circumference as the tube 6.

The ring 12 is provided with slots 15 extending coaxially with the cylindrical portion of the passage hole 14 through an arc of about 45° in order to receive a set of connecting bolts 16. The bolts 16 co-operate with nuts 17 which have been driven into the underside of the cover 2, so that they are fixedly connected with the cover.

One of the ends of each of the slots 15 communicates with a recess 18 engaging the head of the associated connecting bolt 16 in the operative portion of the ring.

The lower ring 13 co-operating with the bottom 3 is provided with square holes 19 for receiving square portions of a second set of connecting bolts 20. The connecting bolts 20 co-operate with nuts 21 screwed on these bolts at the top and adapted to be supported by the bottom 3, whereby the bottom 3 and the ring 13 may be rigidly interconnected.

The above-described information box may be mounted on the post of a bus stop indicator in the following manner.

During manufacture the information box may be mounted on the tube 6 in its definite form and the bus stop indicator panel 11 may also be attached to the tube 6 during manufacture.

For this purpose the cover 2 is slid in upward direction onto the tube 6 together with the upper ring 12 which has already been loosely attached to the cover 2 by means of the connecting bolts 16 until the ring 12 has reached the level of the incisions 8″. The ring 12 is now turned through the angle determined by the slots 15, whereby the ring 12 is guarded against vertical displacement by the ribs 7 and is suspended together with the cover 2 on the tube 6. After that the bottom 3 and the ring 13 are slid over the tube 6 in upward direction until the ring 13 has reached the level of the incisions 8. The ring 13 is now turned and thereby guarded against vertical displacement, after which the ring is rigidly connected with the bottom 3 by means of the connecting bolts 20 and the nuts 21. The ring 13 is received in the bottom 3 in a countersunk position.

After that the information carriers 5 are placed in the grooves 4 of the bottom 3.

The ring 12 is now turned back with respect to the tube 6, so that the ring 12 and the cover 2 may be moved in downward direction, whereby the groove 4 of the cover 2 is brought into engagement with the information carriers 5 and the ring 12 is substantially brought on the level of the incisions 8′ of the ribs 7.

Figure 8:
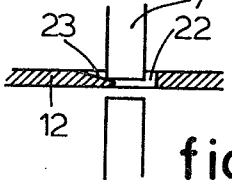
FIG. 8 shows a partial cross-section of the upper ring to indicate the co-operation of this ring with a rib of the tube.
Figure 6:
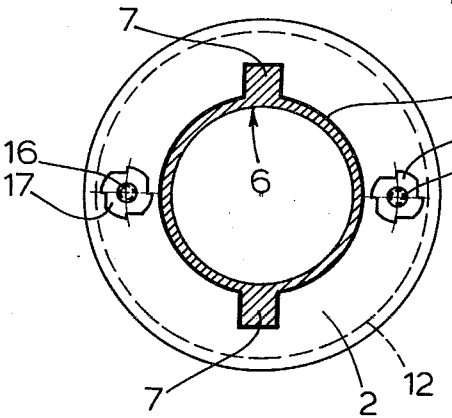
FIG. 6 shows a section along the line VI—VI in FIG. 3.
Figure 4:
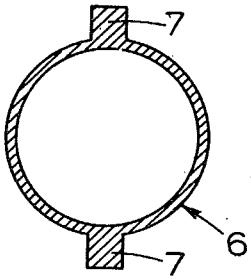
FIG. 4 shows a section along the line IV—IV in FIG. 3.
Figure 7:
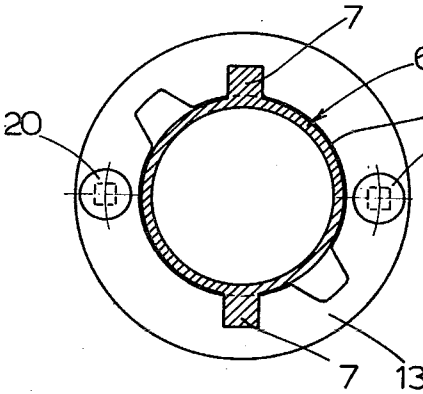
FIG. 7 shows a section along the line VII—VII in FIG. 3.

The grooves 22 provided in the inner surface of the passage hole 14 of the ring 12 in order to receive the ribs 7 when the ring is slid onto the tube, are each provided on one side with a cam surface 23 whereby the ring 12 is downwardly displaced when it is turned from the slide-on position into the operative position (cf. FIG. 8). In this manner the information carriers 5 are effectively clamped between the cover 2 and the bottom 3.

In order that the ring 12 may be rotated it is provided with two operating holes 24 adapted to engage a special tool for exerting the force required for the rotation.

Finally, the connecting bolts 16 are tightened so that they engage the recesses 18 whereby the ring 12 is additionally guarded against rotation. In the operative position the ring 12 is received in the cover 2 in the countersunk condition.

In the place where the information box is to be used, the connecting bolts 16 are loosened to such an extent that they are released from the recesses 18, after which the ring 12 may be turned back to the slide-on position by means of a special tool engaging the operating holes 24. After that the ring 12 and the cover 2 are slid over the tube 6 in upward direction and suspended on the tube 6 at the level of the incisions 8″ by a rotation of the ring. After the information carriers 5 have been removed, the tube 6 is slid on the post 1 from the top and fixed with respect to the post at the desired level. For this purpose the tube 6 is provided with a pair of aligned holes; with the aid of these holes a pair of aligned holes may be drilled in the post 1, after which the transverse bolt 9 may be mounted. After that the information carriers 5 are again placed in the groove 4 of the bottom 3 and the ring 12 is turned back with respect to the tube 6 to its slide-on position. The ring 12 and the cover 2 are moved in downward direction so that the groove 4 of the cover 2 is brought into engagement with the information carriers 5 and the ring 12 is adjusted to the level of the incisions 8′ of the ribs 7. The ring 12 is now turned back to its operative position and the connecting bolts 16 are tightened to complete the assembly.

Figure 1:
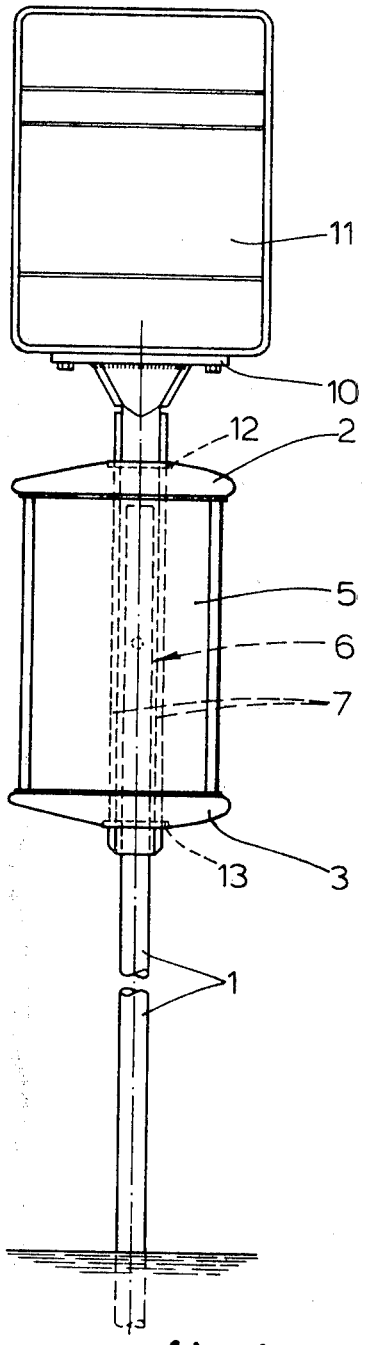
FIG. 1 shows a front view of an information box according to the invention which is attached to the post of a bus stop indicator.
Figure 3:
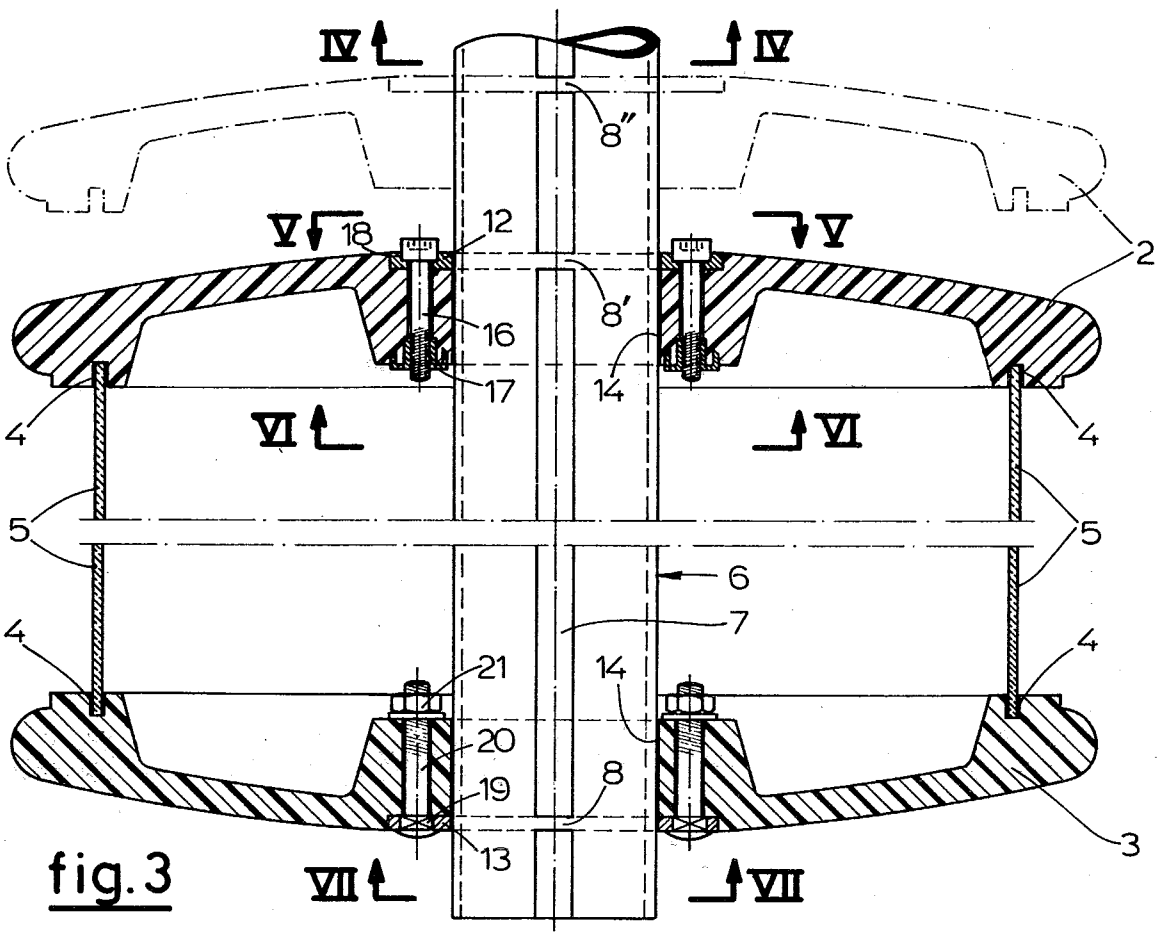
FIG. 3 shows a vertical section of the information box according to FIG. 1 on an enlarged scale.
Figure 5:
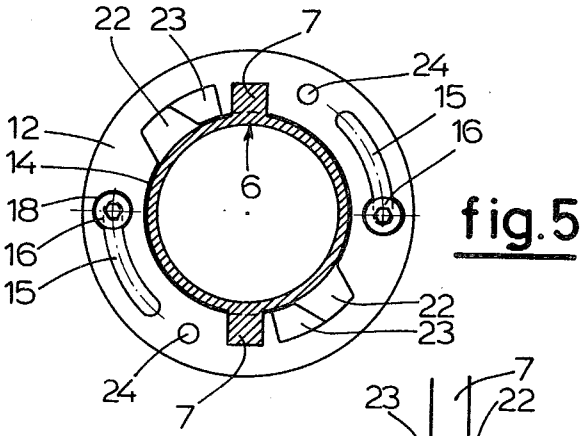
FIG. 5 shows a section along the line V—V in FIG. 3.

As appears in particular from FIG. 1, the transverse bolt 9 is enclosed by the information box in the operative condition so that it is impossible for unauthorized persons to loosen the transverse bolt.

If the information carriers 5 have to be exchanged, the ring 12 and the cover 2 are again suspended in the above-described manner to the tube 6 at the level of the incisions 8″ by a rotation of the ring 12. After the new information carriers 5 have been placed on the bottom 3 the cover 2 and the ring 12 are returned into the operative position in the above-described manner.

The invention is not restricted to the embodiment shown in the drawings which may be modified in various ways within the scope of the appended claims.

I claim:

1. An information box adapted to be attached to the post of a bus stop or tram stop indicator, comprising a cover, a bottom, and a set of information carriers together forming a substantially prismatic structure and enclosed between the cover and the bottom, a tube attachable to said post and provided with at least one outwardly projecting upstanding rib, but otherwise having a cylindrical outer surface through at least part of its height, each rib being provided with two spaced superposed incisions within the zone of said cylindrical outer surface, and an upper ring and a lower ring, connectable with the cover and the bottom, respectively, the cover, the bottom and the rings being provided with passage holes having the same circumference as the tube so that they may be slid on the tube, a groove provided in the inner surface of the passage hole of the rings for receiving the ribs when the rings are slid onto the tube, and the rings being rotatable at the level of the incisions from a slide-on position into an operative position in which they are guarded against vertical displacement by the rib or ribs.

2. An information box as claimed in claim 1, wherein the upper ring is provided with a plurality of slots for receiving connecting bolts, these slots being coaxial with the cylindrical portion of the passage hole.

3. An information box as claimed in claim 2, wherein one end of each of the said slots communicates with a recess engaging the head of the associated connecting bolt in the operative position of the upper ring.

4. An information box as claimed in claim 2, wherein each of the said connecting bolts co-operates with a nut secured to the underside of the cover.

5. An information box as claimed in claim 1, wherein the groove provided in the inner surface of the passage hole of the upper ring for receiving the rib when the ring is slid onto the tube is provided on one side with a cam surface whereby the upper ring is downwardly displaced when it is turned into its operative position.

6. An information box as claimed in claim 1, wherein the rib of the tube is provided with a third incision above the two first-mentioned incisions.

7. An information box as claimed in claim 1, wherein the lower ring is provided with square holes for receiving square portions of a second set of connecting bolts each co-operating with a nut supported by the upperside of the bottom.

8. An information box as claimed in claim 1, wherein the rings are received in the cover and the bottom in a countersunk position.

9. An information box as claimed in claim 1, wherein the tube is provided with two diametrically opposed ribs.

10. An information box as claimed in claim 1, wherein the tube is connectable with the post by means of a transverse bolt extending through holes in the tube and the post and enclosed by the information box in its operative condition.

* * * * *